US005640703A

United States Patent [19]

Brierley et al.

[11] Patent Number: 5,640,703

[45] Date of Patent: Jun. 17, 1997

[54] TREATMENT OF SOLID WASTES

[75] Inventors: Kenneth Walter Brierley; Michael Robert Ellison, both of Warrington, United Kingdom

[73] Assignee: British Nuclear Fuels plc, United Kingdom

[21] Appl. No.: 593,479

[22] Filed: Jan. 29, 1996

Related U.S. Application Data

[63] Continuation of Ser. No. 229,230, Apr. 18, 1994, abandoned.

[51] Int. Cl.[6] ..... G21F 9/00

[52] U.S. Cl. ..... 588/1; 134/3; 134/10; 134/26; 423/20

[58] Field of Search ..... 588/1; 134/3, 10, 134/22.17, 22.19, 26; 423/20

[56] References Cited

U.S. PATENT DOCUMENTS

| | | | |
|---|---|---|---|
| 2,896,930 | 7/1959 | Menke | 299/5 |
| 3,013,909 | 12/1961 | Pancer et al. | 134/4 |
| 3,080,262 | 3/1963 | Newman | 134/4 |
| 3,130,960 | 4/1964 | Martin | 299/5 |
| 3,297,580 | 1/1967 | Ritzer | 252/142 |
| 3,496,017 | 2/1970 | Weed | 376/309 |
| 3,615,817 | 10/1971 | Jordan et al. | 134/3 |
| 3,778,497 | 12/1973 | Deaton et al. | 423/2 |
| 3,873,362 | 3/1975 | Mihram et al. | 134/3 |
| 4,226,640 | 10/1980 | Bertholdt | 134/3 |
| 4,690,782 | 9/1987 | Lemmens | 252/626 |
| 4,704,235 | 11/1987 | Arvesen | 252/626 |
| 4,705,573 | 11/1987 | Wood et al. | 134/3 |
| 4,729,855 | 3/1988 | Murray et al. | 252/626 |
| 4,731,124 | 3/1988 | Bradbury et al. | 134/3 |
| 4,830,738 | 5/1989 | White | 209/166 |
| 5,205,999 | 4/1993 | Willis et al. | 423/20 |
| 5,322,644 | 6/1994 | Dunn et al. | 252/626 |

OTHER PUBLICATIONS

Ashby, P.J. et al, Washing of Plutonium Contaminated Combustible Material Preliminary Active Experiments Using the AERE 5 Batch Wash Rig U.K. At. Energy Res. Establ., [Rep.] AERE (1985) AERE–R 11479, 24 pp.

Ashby, P.J. et al., Washing of Plutonium Contaminated Combustible Material, Washing of Real Waste Materials, U.K. At Energy Res. Establ., [Rep]. AERE (1985), AERE–R 11730, 41 pp.

*Primary Examiner*—Ngoclan Mai

*Attorney, Agent, or Firm*—Nixon & Vanderhye

[57] ABSTRACT

A process for the treatment of solid waste material which is or is suspected to be contaminated with plutonium or compounds thereof with or without other hazardous contaminants, which process includes: contacting the said material with and thereby dissolving contaminants as complexes by a liquid medium which comprises Solution X which comprises an aqueous solution which is free of ingredients which are naturally degradable to non-toxic products with or without mild physical assistance such as heat or ultra-violet radiation, said solution comprising:

(a) carbonated water;

(b) a conditioning agent; and (c) a complexing agent which comprises the anion of a single or multiple carboxylic acid species having from 2 to 6 carbon atoms in each carboxylic acid species;

and separating the liquid medium from the waste material and recovering the dissolved contaminants from the liquid medium and wherein the step of contacting the waste material with the said liquid medium is preceded by a step of contacting the waste material with a dissolver solution of non-neutral pH different from the pH of the said liquid medium whereby solid contaminant particles are washed from the waste material and/or dissolved as simple ions in the dissolver solution.

10 Claims, 1 Drawing Sheet

TREATMENT OF SOLID WASTES

This is a Rule 62 File Wrapper continuation of application Ser. No. 08/229,230, filed 18 April 1994, now abandoned.

BACKGROUND OF THE INVENTION

The present invention relates to the treatment of solid wastes and particularly to processes suitable for the treatment of wastes which are or are suspected to be contaminated with plutonium or compounds thereof.

Published GB 2229312A by the present applicants describes an aqueous medium comprising a solution which was designed for the purpose of dissolving, to enable separation of, actinides contained in so-called Magnox sludge resulting from the long-term storage underwater of irradiated nuclear fuel encased in containers made of Magnox, a magnesium alloy. U.S. Pat. No. 5,205,999 describes the extension of the use of that solution to washing of contaminated soil.

The said solution herein referred to as "Solution X" is as follows:

Solution X comprises an aqueous solution which is free of heavy metal ions (prior to use thereof) and comprises ingredients which are naturally degradable to non-toxic products with or without mild physical assistance such as heat or ultra-violet radiation, said solution comprising:

(a) carbonated water;

(b) a conditioning agent; and (c) a complexing agent which comprises the anion of a single or multiple carboxylic acid species having from 2 to 6 carbon atoms in each such carboxylic acid species.

We have discovered that Solution X unexpectedly and beneficially has other applications. The said Solution X may be used in the treatment of plutonium contaminated wastes as follows:

SUMMARY OF THE INVENTION

According to the present invention there is provided a process for the treatment of solid waste material which is or is suspected to be contaminated with plutonium or compounds thereof with or without other hazardous contaminants, which process includes contacting the said material with a liquid medium which comprises Solution X as hereinbefore defined thereby dissolving contaminants as complexes in said liquid medium, separating the liquid medium from the waste material and recovering the dissolved contaminants from the liquid medium and wherein the step of contacting the waste material with the said liquid medium is preceded by a step of contacting the waste material with a dissolver solution of non-neutral pH different from the pH of the said liquid medium whereby solid contaminant particles are washed from the waste material and/or dissolved as simple ions in the dissolver solution.

The dissolver solution may comprise a strongly acidic or a strongly alkaline washing solution, eg having a molar acid or alkali concentration greater than about 0.1M, desirably greater than 0.5M and preferably greater than 1M. The pH of the solution is thus desirably in the acidic range pH 0 to 2, preferably pH 0 to 1, or in the alkaline range pH 12 to 14, preferably 13 to 14. In comparison, the reagent concentration in the case of Solution X is desirably less than 0.01M and the pH is desirably in the range 4 to 11, eg 5 to 9.

The dissolver solution followed by the Solution X-containing liquid medium provide different and beneficially complementary contaminant plutonium dissolution media. Contacting the waste material with the dissolver solution allows plutonium containing contaminant particles to be dislodged by and dissolved in the solution. Up to 90% or more of the plutonium content may conveniently be dispersed in this manner. Subsequently contacting the waste material with the liquid medium comprising Solution X allows the remaining plutonium containing contaminants to be dissolved by a different regime. Such contaminants may for example be more tightly bound physically and/or chemically to the waste material and although not dissolved by the strong dissolver solution are leached by the milder but chemically different Solution X.

Either or both of the contacting with the dissolver solution and the contacting with the Solution X may be preceded by or followed by one or more other washing steps. For example, the contacting with dissolver solution may be preceded by contacting the waste material with an aqueous solution comprising a surfactant and/or contacting with a liquid or vapour phase organic solvent to degrease the waste or to remove hazardous organic contaminants. Contacting with the Solution X containing liquid may be followed by washing with water optionally containing a small concentration, eg not more than 5 per cent by weight in total, of an organic or inorganic additive.

The waste material treated by the process of the present invention may comprise material such as transuranic (TRU) wastes or plutonium contaminated material (PCM). In either case waste material is contaminated with plutonium or plutonium compounds with or without other actinides and other hazardous (radioactive or non-radioactive) contaminants.

Such wastes may have been obtained from a nuclear materials processing or reprocessing plant in which plutonium is handled as a material for use in or as a product of a nuclear fission reaction. The materials may include organic waste materials such as waste textiles or rubbers, eg clothing materials or waste papers, plastics and the like.

The waste material to be treated may alternatively or in addition comprise solid inorganic objects or bodies such as metal pipes, boxes, rubble and the like.

Where the waste material is soft it is desirably chopped or shredded and where the waste material is hard material of large size it is desirably reduced in size by cutting, cracking, breaking, grinding or chopping as appropriate depending on the type of materials involved.

In both cases, reducing the size of the material increases the surface area thereof and facilitates contacting of the surfaces of the material and embedded contaminants therein in the various liquid contacting stages.

It may be desirable to apply a pre-treatment step in which the materials to be treated are separated physically into soft and hard materials or materials of different kinds which can be reduced in size and if appropriate treated in different ways. These separated batches may then be treated by different processes. For example, the material may be screened by a materials discrimination detection system having an on-line monitor, eg an X-ray inspection system, and portions to be separated may be remotely handled by an operator observing the monitor.

The various liquid contacting stages may be operated as batch treatments or as one or more continuous treatment processes in which solid material being treated is passed from one stage to the next. The stages, which may comprise washing or leaching stages, may themselves comprise a number of sub-stages.

The process according to the present invention may include the steps of feeding a feedstock of the waste material through a series of treatment stages in which it is contacted with a washing liquid and then separated from the washing liquid, washing liquid removed from at least one of the stages being passed to the stage previously encountered by the feedstock whereby the feedstock and washing liquid are passed in opposite senses or countercurrent fashion with respect to adjacent stages. At least one of the treatment stages may include the aforementioned step of contacting with strong acid or alkali dissolver solution and at least one more of the treatment stages may include the aforementioned step of contacting with a liquid medium comprising Solution X.

The said treatment stages may be preceded by another liquid treatment stage in which the feedstock is treated by another extractant solution, eg surfactant wash organic solvent. The use of different extractant solutions in different stages allows sequential extraction of contaminants of different types thereby facilitating their separate treatment whilst minimizing the volume of liquid employed in the process by using the countercurrent method.

The contaminants of a first kind dissolved in the first stage to be encountered may comprise organic contaminants such as halogenated solvents, petroleum hydrocarbons and polyaromatic hydrocarbons.

The contaminants of a second kind dissolved in subsequent stages (including the dissolver solution and Solution X stages) may include:

(i) actinides or their radioactive decay products or compounds thereof;

(ii) fission products;

(iii) heavy metals or compounds thereof.

Actinides are elements having periodic numbers in the inclusive range 89 to 104.

The term 'fission product' as used herein refers to those elements formed as direct products (or so-called 'fission fragments') in the fission of nuclear fuel and products formed from such direct products by beta decay. Fission products include elements in the range from selenium to cerium including elements such as $_{56}$Ba, $_{40}$Zr and $_{52}$Te $_{55}$Cs and $_{58}$Ce.

Heavy metals desired in addition to plutonium to be separated by the process of the present invention include toxic metals such as chromium, lead, cadmium and mercury which are commonly found as earth contaminants near industrial plants and on waste disposal sites and in aquatic sediments employing chemicals containing those elements and in wastes generated by industrial plants, eg industrial residues, slags and the like.

The contaminants separated in the second stage may include a mixture of radioactive and non-radioactive metallic contaminants. Alternatively, a further extractant treatment stage may be employed in order to extract non-radioactive metallic and radioactive contaminants in separate stages or selected contaminants in different stages.

Where treatment with an extractant liquid is followed by a washing stage the washing liquid may comprise water optionally with one or more additives, eg up to 5 per cent by weight such as inorganic additives, eg pH adjusters, to avoid precipitation, or one or more organic additives, eg polyelectrolyte.

The first extractant employed to remove organic contaminants may comprise a first aqueous solution or an organic solvent.

Extractant leaving the first stage and containing organic contaminants may be passed to a separator in which the dissolved organic contaminants are extracted. The clean extractant solution may thereafter be recirculated to the first stage.

Likewise, extractant leaving the second and third extractant treatment stages having radioactive contaminants including plutonium dissolved or dispersed therein may be passed to a separator or separators in which the contaminants are extracted. The extractant solution may thereafter be recirculated to the extractant treatment stage from which it was obtained.

In a process embodying to the present invention the feedstock of waste material may be passed sequentially through the first extractant treatment stage, for organic removal, a second extractant treatment stage for alkali dissolution of contaminants, a first water washing stage, a third extractant treatment stage for contacting with Solution X and a second water washing stage. Water (together with any optional additive(s)) extracted from the first water washing stage may be passed in countercurrent fashion to the alkali treatment stage. Similarly, water extracted from the second water washing stage may be passed in countercurrent fashion to the third extractant (Solution X) treatment stage.

In this way, where the first extractant is applied to remove organic contaminants and the second and third extractants (comprising the said dissolver solution and solution X respectively) are applied to remove plutonium together with other metal and/or radioactive contaminants, the first water washing stage frees the particulate material of entrained organic contaminants and remains of first extractant which might adversely affect the performance of the third extractant, eg by coating the feedstock material and preventing the third extractant contacting the particles. The second water washing stage frees the material of the feedstock from remains of the second and third extractants respectively and dissolved contaminants.

Any one or more of the said stages may itself include a plurality of sub-stages each including a contactor for contacting the feedstock with washing liquid from the next sub-stage which the feedstock is to encounter and a separator for separating the washed feedstock from the washing liquid.

The said process embodying the present invention may include one or more pre-treatment steps before the said treatment stages. The pre-treatment steps may comprise one or more of size reduction, sorting into different kinds of materials, screening, crushing and scrubbing to form pieces of the correct size in the feedstock material.

In the process embodying the present invention where the first extractant is applied to extract organic contaminants the extractant may comprise a surfactant, eg sodium dedocylsulphonate, an organic liquid or vapour, eg a halogenated solvent or a proprietary chemical.

In Solution X described above the carbonated water may comprise $CO_3^{--}$ or $HCO_3^-$ ions in aqueous solution.

The pH of the said aqueous solution comprising Solution X may be in the range 4 to 12, especially 5 to 9, and may be controlled using a carbonate such as sodium carbonate to provide the carbonated solution and/or use of another alkaline ingredient, eg sodium hydroxide.

Desirably, the said process according to the present invention is one which may be carried out a temperature of less than 35° C. and which gives no toxic or explosive off gases.

Desirably, the said Solution X contains no ingredients, eg nitrates or sulphates, which will damage building materials, eg concrete, in which the material to be treated might be contained or promote a runaway reaction with uncorroded metals, eg any magnesium present.

The complexing agent of Solution X may be selected from the anion of a carboxylic acid in the group consisting of citric acid, acetic acid, oxalic acid and EDTA (ethylenediamine tetracetic acid).

The said conditioning agent may comprise an oxidising agent such as hydrogen peroxide, ozone, oxygen-enriched air or potassium permanganate, or a reducing agent such as hydrazine or hydroxylamine. Hydrogen peroxide is preferred.

Desirably, the complexing agent is present in Solution X in the said solution in a concentration in the range from 0.0001 to 5 Mol $dm^{-3}$, especially 0.0005 to 0.1 Mol $dm^{-3}$.

Desirably, the said conditioning agent is present in the said Solution X in a concentration in the range from 0.01 Molar to 3 Molar.

It is believed that the conditioning agent changes the oxidation state of the contaminant metal to a state which renders the metal soluble by forming a complex with the complexing agent and/or by the natural solubility of the conditioned cation in the leaching solution. The complex produced by the complexing agent and the metal may facilitate the oxidation or reduction carried out by the conditioning agent.

For example, it is thought that citrate ions and insoluble plutonium form a soluble plutonium complex, and that the presence of citrate ions facilitates the oxidation of the plutonium by the conditioning agent, eg hydrogen peroxide, to a more soluble oxidation state, such as plutonium (IV).

Each washing stage (or each sub-stage within such stage) may comprise a stirred tank or a rotating drum or a tumbler, or blender or a percolator or a fluidised bed as a liquid/solid contactor and a hydrocyclone or filter or a centrifuge or a settling tank as a liquid/solid separator.

Where separation includes filtration the filtration may be by one or more of a number of known types of filtration system, eg vacuum filters, pressure filters and ultrafilters.

As an alternative to the mixing process the aqueous medium may be percolated through the shredded waste to wash it. The medium may be applied to the waste by spraying for example or by use of a fluidised bed. In this case however the particles of waste solid need to be small enough to allow all solid surface to be contacted by the aqueous medium.

In the vessel employed for contacting the solid waste to be washed with the aqueous medium the waste may be washed in successive discrete batches. Alternatively, the waste may be continuously fed into and extracted from the vessel.

Organic material removed in the first extractant may be treated in a known way in the extractant, eg by biotreatment or oxidation, or separated from the extractant and treated separately, eg decomposed by incineration or recovered (if useful) eg by distillation, or immobilised, eg by sorption.

Metallic or radioactive contaminants may be removed from the second extractant in the second extractant separator or from the third extractant in the third extractant separator by a known method. The recovery may be by one of the known methods employed for recovering contaminants from solutions in which they are dissolved, such as solvent extraction and/or evaporation, and/or ion exchange, and/or floc treatment, and/or precipitation and/or filtration for particulate contaminants eg undissolved $PuO_2$. Other processes such as reverse osmosis may be employed to purify the separated liquid medium further which, after purification, may be re-used, eg by recirculation, in the waste material washing process.

The plutonium and other hazardous material may thereby be obtained in highly concentrated form. If desired, the plutonium can be further separated from the other separated species in a known way eg as conventionally employed in irradiated nuclear fuel reprocessing methods. All procedures for handling concentrated plutonium and other hazardous elements are carried out by remote operations in radiation shielded enclosures.

The contaminant concentrate residue obtained from the above processes may be treated and disposed of in a manner suitable for the type of contaminants involved. For example, plutonium or other actinides separated from the residue may be subsequently isolated for re-use by selective versions of one or more of the aforementioned separation processes. The disposable residue may be handled and disposed of by one of the methods known for the disposal of high level or transuranic radioactive waste associated with irradiated nuclear fuel. For example, the residue may be encapsulated in glass by a known vitrification technique carried out remotely within a radiation-stable structure eg made of concrete.

Such actinide separation and residue encapsulation, eg vitrification, are processes currently employed by the present Applicants at their Sellafield reprocessing plant.

The objective of using the process of the present invention is that after the waste washing process has taken place the waste is reduced to a safer state. Normally, it will be transported to a low level storage site. In many cases the state of the waste should be sufficiently safe, either immediately or after a suitable time.

Embodiments of the present invention will now be described by way of example with reference to the accompanying drawings, in which:

DESCRIPTION OF THE PREFERRED EMBODIMENTS

EXAMPLE 1

Figure 1:
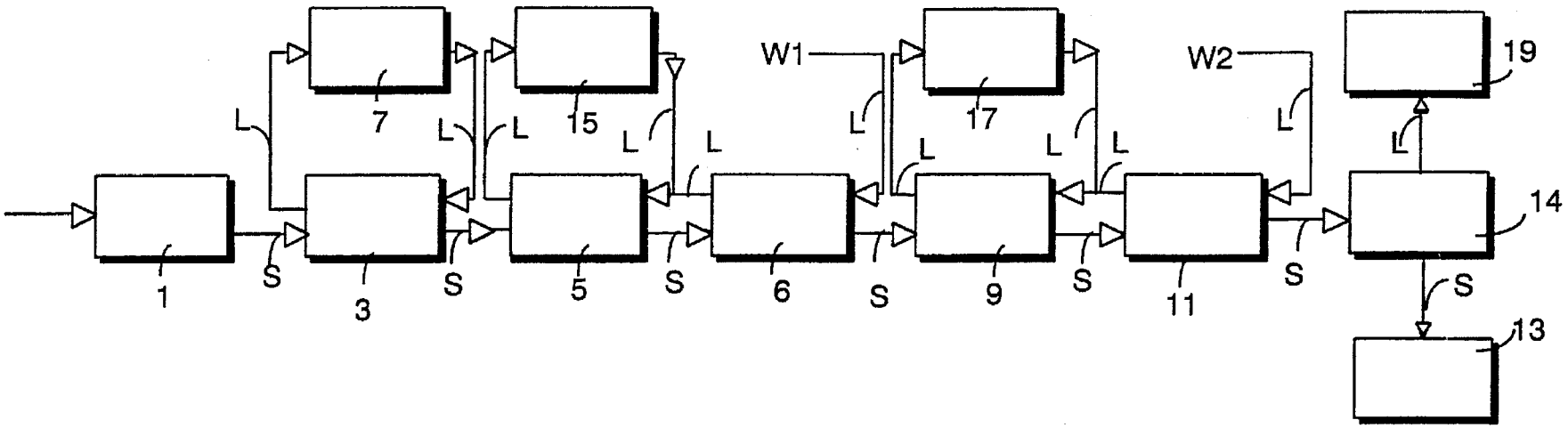
FIG. 1 is a block schematic diagram illustrating a sequence of stages in a countercurrent leaching process embodying the invention.

Waste clothing items from use at a nuclear materials processing facility which are contaminated with plutonium together with other actinides eg Am and Np and fission products are collected in a radiation stable container. The contents of the container are transported to a shielded shredder where they are shredded using a remotely controlled manipulator into pieces having a surface area not greater than 10 $cm^2$. The pieces are washed with an aqueous sodium hydroxide solution typically 1.0M for about several hours after which the washings containing actinides are drained. The waste is then rinsed with water and the washings are drained. The shredded pieces are then treated as follows. A solution which is an example of Solution X comprising water, sodium carbonate, sodium citrate (0.1M concentration as a typical example) and $H_2O_2$ (0.1M as a typical example) is continuously sprayed at ambient temperature over the top surface of the shredded waste and is allowed to percolate through the waste to a collecting trough below, where it is collected. The collected solution is transferred to an ion exchange plant where the dissolved actinide and fission product ions and complexes are held. The actinides can subsequently be recovered from the resin in a known way, eg by addition of a solution of nitric acid which redissolves the captured actinides, followed by subsequent treatment, eg selective solvent extraction, to separate the individual actinides. The remaining active residue separated from the solution is treated by encapsulation, eg vitrification. The washed waste is allowed to dry by evaporation and is then reboxed and transported to a low level waste disposal site.

EXAMPLE 2

Waste clothing items contaminated with actinides especially Pu, Am and Np and fission products is transported to a treatment site as in Example 1. At the treatment site the waste is treated as in Example 1 except that when the washed waste has been transported to a disposal site as in Example 1, the various washings are treated separately by floc treatment to concentrate the actinides prior to encapsulation and transport to a repository.

EXAMPLE 3

FIG. 1 illustrates a further example of a process embodying the present invention. In FIG. 1 arrows labelled S indicate flow of solid material and arrows labelled L indicate flow of cleaning liquids. Material to be treated, eg shredded waste material, is given any necessary pre-treatments eg size reduction, materials type sorting, crushing, sieving, scrubbing in a preliminary step 1 (which may in practice be a series of steps), after which it is applied as feedstock material to a first extractant treatment stage 3 in which dissolved organic contaminants are removed. The feedstock material is contacted in stage 3 with a suitable organics extractant such as a degreasing vapour or a solvent wash followed by drying and the extractant together with organic material extracted passed through a separator 7. The separator 7 allows in a known way organic contaminants to be collected. The extractant medium may be recirculated (optionally after one or more purification stages) for reuse in the treatment stage 3.

After treatment in the organics removal stage 3 the solid feedstock material is separated (if necessary) from the extractant and passed to an alkali treatment stage. In this stage the material is contacted with NaOH solution, typically 1M in concentration, which dislodges and dissolves plutonium and other contaminant metals (radioactive and/or non-radioactive). The contaminant-containing NaOH solution is delivered to a separator 15 which extracts the contaminants from the solution. The solution may after one or more purification steps (not shown) be recirculated for further use in the stage 5. Water from the next stage together with fresh NaOH is supplied to stage 5. After contacting and separation of the feedstock material at stage 5 the feedstock material is passed on to a first water washing stage 6 in which water from a water source W1 is contacted with the feedstock material to wash the material, after which the water is separated from the feedstock material and applied as an input to the earlier alkali treatment stage 5 as mentioned above.

The feedstock material is next passed to an extractant treatment stage 9 in which residual heavy metal or radioactive contaminants are removed. The feedstock material is contacted in stage 9 with an aqueous solution comprising a mixture of water obtained from the output of a second water washing stage 11 (to which the feedstock is next to be applied after the stage 9) and input extractant solution for metals and/or radioactive contaminants obtained from a separator 17. This extractant is Solution X as used in Example 1 described above. After washing with the extractant solution in stage 9 the solid feedstock material is separated from the solution and passed to the second water washing stage 11. Extractant solution containing dissolved contaminants is passed from stage 9 to the separator 17 in which the dissolved contaminants are removed to enable clean extractant solution to be recirculated as input to stage 9.

In the washing stage 11, water from a water source W2 is contacted with the feedstock material to further wash the material after which the water is separated from the feedstock material and applied as an input to the earlier stage 9 as mentioned above.

Finally, the output feedstock material is separated in a separator 14 into washings 19 and clean, decontaminated solid material 13 which may be disposed of in a low level waste disposal facility.

The concentrated plutonium and other heavy metal contaminants separated in the separators 15 and 17 may be further treated, and disposed of in one of the ways described above.

We claim:

1. A process for the treatment of solid waste material which is or is suspected to be contaminated with plutonium or compounds thereof with or without other hazardous contaminants, which process includes the steps of:

(1) contacting the said material with and thereby complexing the contaminants with a liquid medium which comprises an aqueous solution of (a) carbonated water; (b) a conditioning agent; and (c) a complexing agent which comprises the anion of a single or multiple carboxylic acid species having from 2 to 6 carbon atoms in each carboxylic acid species; wherein said aqueous solution is free of ingredients which are naturally degradable to non-toxic products with or without mild physical assistance; and (2) separating the liquid medium from the waste material; and (3) recovering the complexed contaminants from the liquid medium, wherein prior to step (1) the waste material is contacted with an aqueous washing solution of non-neutral pH different from the pH of the said liquid medium whereby solid contaminant particles are washed from the waste material.

2. A process as in claim 1 and wherein the aqueous washing solution comprises a strongly acidic or a strongly alkaline washing solution having a molar acid or alkali concentration greater than about 0.1M.

3. A process as in claim 2 and wherein the reagent concentration of the aqueous solution used in step (1) is less than 0.01M.

4. A process as in claim 1 and wherein at least 90 percent of the plutonium content of the solid waste material is dislodged by the washing solution, the remaining plutonium content being substantially complexed by treatment with the Solution X.

5. A process as in claim 1 wherein the solid waste material is washed with water prior to or after contact with the washing solution.

6. A process as in claim 5 and wherein the waste material is contacted with an aqueous solution or vapor phase organic solvent prior to contact with the washing solution.

7. A process as in claim 1 and wherein the waste material is sorted and shredded or otherwise reduced in size prior to contacting by the washing solution.

8. A process as in claim 1 and wherein the liquid contacting stages are operated as a continuous treatment processes in which solid waste material being treated is passed from one stage to the next.

9. A process as in claim 8 and wherein the process includes the steps of feeding a feedstock of the waste material through a series of treatment stages in which it is contacted with a washing liquid and then separated from the washing liquid, the washing liquid removed from at least one of the stages being passed to the stage previously encountered by the feedstock whereby the feedstock and washing liquid are passed in countercurrent fashion with respect to adjacent stages, at least one of the treatment stages including the step of contacting with the dispersing solution and at least one more of the treatment stages including the step of contacting with the liquid medium used in step (1).

10. A process as in claim 9 and wherein the treatment stages are preceded by another liquid treatment stage in which the feedstock is treated by another extractant solution comprising a surfactant wash organic solvent.

* * * * *